US006267899B1

(12) United States Patent
Greig et al.

(10) Patent No.: US 6,267,899 B1
(45) Date of Patent: Jul. 31, 2001

(54) CENTRIFUGAL SEPARATION APPARATUS AND METHOD OF USING THE SAME

(75) Inventors: Christopher Roy Greig; Peter James Tait; Russell Kirk, all of South Brisbane (AU)

(73) Assignee: STG-FCB Holdings PTY Ltd. (AU)

( * ) Notice: Subject to any disclaimer, the term of this patent is extended or adjusted under 35 U.S.C. 154(b) by 0 days.

(21) Appl. No.: 09/323,279

(22) Filed: Jun. 1, 1999

Related U.S. Application Data

(63) Continuation-in-part of application No. 08/687,549, filed on Apr. 22, 1997, now abandoned.

(51) Int. Cl.[7] ..... C13F 1/06

(52) U.S. Cl. ..... 210/781; 210/787; 210/360.1; 210/369; 210/377; 210/380.1; 127/19; 494/36; 494/37; 494/56; 494/57

(58) Field of Search ..... 210/781, 787, 210/360.1, 369, 377, 380.1; 494/43, 56, 57, 36, 37; 127/19

(56) References Cited

U.S. PATENT DOCUMENTS

| | | |
|---|---|---|
| 2,058,739 | 10/1936 | Stoner . |
| 2,910,184 | 10/1959 | Strich . |
| 3,799,353 | 3/1974 | Pause . |
| 3,844,949 | 10/1974 | Mercier . |
| 4,008,908 | 2/1977 | Dietzel et al. . |
| 4,205,999 | 6/1980 | Zeichner et al. . |
| 4,804,419 | 2/1989 | Schaper et al. . |
| 5,300,013 | 4/1994 | Frassdorf et al. . |

FOREIGN PATENT DOCUMENTS

| | | |
|---|---|---|
| 65136/69 | 12/1969 | (AU) . |
| 104368 | 1/1994 | (AU) . |
| A20931 | 1/1994 | (AU) . |
| 1 532 688 | 4/1970 | (DE) . |
| 3615224A1 | 11/1987 | (DE) . |
| 0 031 549 | 7/1981 | (EP) . |
| 1 355 763 | 2/1963 | (FR) . |
| 1 379 054 | 10/1963 | (FR) . |
| 1 483 826 | 3/1966 | (FR) . |
| 2563448A3 | 10/1985 | (FR) . |
| 918386 | 2/1963 | (GB) . |
| 7909208 | 7/1981 | (NL) . |

*Primary Examiner*—David A. Reifsnyder
(74) *Attorney, Agent, or Firm*—Burns, Doane, Swecker & Mathis, LLP

(57) ABSTRACT

Centrifugation separations apparatus including centrifugation means having an inlet, a liquids discharge and a solids discharge, a deflector operatively associated with the solids discharge, wherein the solids discharge is adapted to operatively discharge solids being discharged from the centrifugation means at a trajectory and the deflector is adapted to interrupt the trajectory to decelerate and change the direction of travel of the solids, or wherein the deflector is operatively associated with the solids discharge and cooperable with solids being discharged from the solids discharge whereby buildup of solids on the deflector is substantially prevented, or wherein the solids discharge includes a lip configuration which causes the trajectories of the discharging crystals to be relatively independent of their size and/or their residual syrup/moisture content, or including support means, such as a spider like construction having one or more webs substantially parallel to the angular motion of the solids being discharged from the solids discharge, operatively supporting the centrifugation means whereby the impact area for solids discharged from the solids discharge may be minimized, or including blending means operatively associated with the solids discharge for blending solids discharged from the centrifugation separations apparatus.

17 Claims, 8 Drawing Sheets

CENTRIFUGAL SEPARATION APPARATUS AND METHOD OF USING THE SAME

This application is a continuation-in-part of U.S. Ser. No. 08/687,549, filed Apr. 22, 1997, now abandoned.

BACKGROUND OF THE INVENTION

1. Field of the Invention

This invention relates to centrifugal separation apparatus.

This invention has particular but not exclusive application to a continuous centrifuge for separating sugar crystals from a sugar solution, or massecuites and it will therefore be convenient to hereinafter refer to this example application. However It is to be clearly understood that this invention could be used in other applications for separating other solid/liquid mixtures.

2. Brief Description of the Art

In the processing of sugar crystals, a filtration centrifugation separation process, eg a centrifuge, is frequently employed to separate sugar crystals from a sugar solution. This is especially so for highly pure crystal sugar for consumption or refining where crystal quality is important.

In most known industrial applications, the separation of sugar crystals from massecuite and washings is carded out in batch processes using batch centrifuges. In a batch centrifuge, a predetermined charge of massecuite is delivered to a centrifuge basket. The basket is then accelerated to a predetermined angular velocity and held for a predetermined spin time to achieve a desired level of syrup removal before wash water and/or an alternative liquid is sprayed onto the exposed crystal layer for a predetermined "wash time". The basket is then hold at the aforementioned, or an alternative, angular velocity before decelerating the basket and discharging the washed crystals therefrom.

Some advantages of the batch centrifuge are that crystal size and shape are preserved since the crystals do not undergo any high velocity impacts and that by appropriate selection of spin times and wash times, the required level of residual impurities can be controlled. However these machines require time to be charged with feedstock and emptied of product and also require time to accelerate and decelerate thus reducing their effective capacity, Thus the batch operation imposes a considerable down time thereby requiring a relatively larger number of filtration centrifugation units to satisfy the throughput of a sugar crystallization plant.

Maintenance requirements are significant due to the cyclic operation of the equipment and power consumption is increased due to the inefficiency of the cyclic operation.

Attempts have been made to develop continuous centrifuges suitable for producing high quality sugar crystals. However these attempts have not produced very satisfactory results. A major problem with known continuous centrifuges is crystal breakage caused by high speed impacts between crystals leaving the conical basket and the walls of a sugar chamber and also crystal impacts with other crystals. In addition, wet lumps of sugar may agglomerate and these naturally adversely affect sugar crystal quality.

As a result continuous centrifuges have not been widely used up to now for high purity product sugar separation. However in view of the obvious shortcomings of batch centrifuges as articulated above, It would clearly be advantageous if a continuous centrifuge could be devised which preserved a good sugar crystal quality, eg suitable for consumption and use in refining.

OBJECTS AND SUMMARY OF THE INVENTION

According to one aspect of this invention there is provided a centrifugal separation apparatus for separating sugar crystals from a sugar syrup, the apparatus including:

an open topped basket having a discharge kip of curved convex configuration towards an upper end thereof over which sugar crystals pass when they are discharged from the basket; and a deflector spaced radially outwardly of the lip for deflecting sugar crystals discharged from the basket downwardly into a sugar chamber.

Preferably said convex discharge Up has a radius greater than or equal to the radius calculated by the following formula:

$$V^2/\delta = 9.8 \cos\theta + Rw^2 \sin\theta$$

where

V is the relative velocity between the crystals and the centrifuge;

θ is the angle from a horizontal axis at which free solids leave the centrifuge and is less than or equal to 2;

R is the basket radius of the centrifuge at θ;

w is the rotation speed in radians per second of the centrifuge;

δ is the lip radius at the top of the centrifuge.

V is difficult to determine but is typically in the range 0.5 to 5 $ms^{-1}$ and for high grade sugar applications close to 1 $ms^{-1}$ Typically, θ would be selected at or near 1° as shown in FIG. 5.

Advantageously the curved convex discharge lip causes the trajectory of the sugar crystals to be independent of their size and weight and to make the initial impact at broadly the same height on the deflector.

According to another aspect of this invention there is provided a process for continuously centrifuging sugar crystals from a mixture of crystals and syrup, the process including:

continuously feeding the mixture into a centrifuge as described above with respect to the first aspect of the invention through the inlet thereof, centrifuging the massecuites in the basket of the centrifuge so that liquid passes through openings in the wall of the basket and the crystals move progressively up the wall of the basket;

discharging crystals from the basket by passing them over said discharge lip;

and deflecting the crystals off the deflector downwardly towards the solids outlet

BRIEF DESCRIPTION OF FIGURES

In order that this invention may be more readily understood and put into practical effect, reference will now be made to the accompanying drawings which illustrate a typical embodiment of the invention and wherein.

DETAILED DESCRIPTION OF THE PREFERRED EMBODIMENTS OF THE INVENTION

Figure 1:
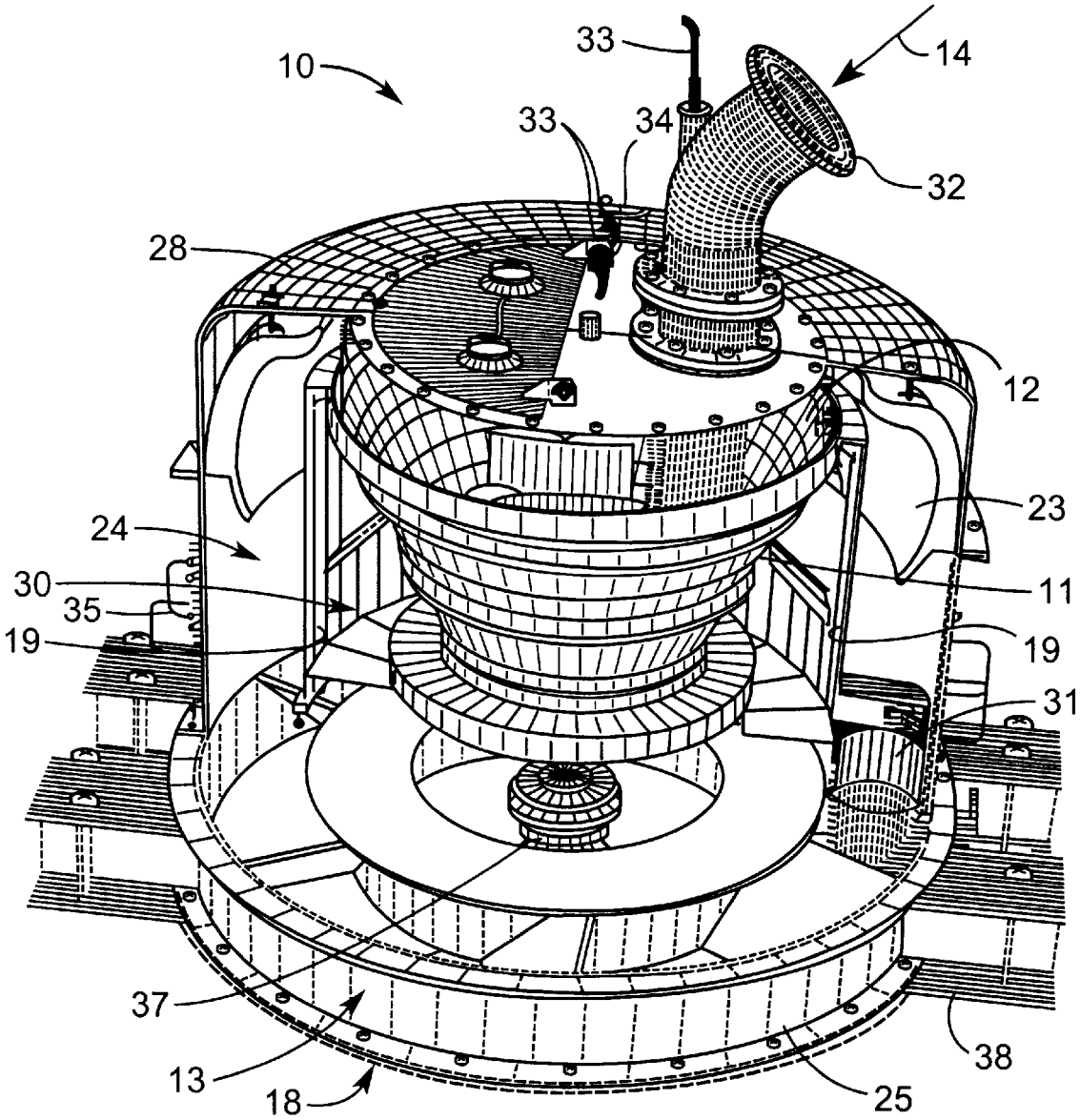
FIG. 1 is a partly cut away view of a centrifugal separations apparatus.

In use the massecuites forms a thin layer which flows progressively up the conical wall of the basket as it is spun at high speed. As a consequence of the centrifugal force applied to the mixture, a thin layer of the mixture is formed which flows up the conical screen with continuous progressive removal of syrup from the mixture through the screen. The filtering and motion of the layer on the screen leads to the classification of crystals with the finer crystals moving towards the screen. The sugar solution passes through the wall of the basket where it is collected in a liquid collection chamber, eg a syrup chamber. A layer of sugar crystals, flows up the conical wall towards the discharge lip. Sugar syrup or water and/or steam may be poured onto the sugar crystals flowing upwardly along the wall of the basket to remove residual syrup from the crystals. This was washing may be accomplished by an arrangement of sprays and a control system which varies the rate of application of spray water.

Crystals discharge from the lip of the conical basket on a tangential path with a velocity component in each of the vertical and the radial directions somewhat smaller than the velocity component in the circumferential direction. Additionally, the vertical component of the crystal velocity is typically very small. The classification of crystals in the layer on the screen may be expected to result in the purged crystals taking varying trajectories upon leaving the basket. Specifically, the fine crystals will tend to have retained some residual liquid and as a result may be expected to follow the top edge of the basket with very little vertical velocity, The larger dryer crystals may be expected to leave with a vertical velocity component similar to that which they had while traveling up the screen. However, it is believed that the lip radius configuration for solids discharge described herein causes all the solids to take a similar trajectory.

After discharging over the lip the crystals then travel through the sugar chamber with a flattened trajectory at a small angle to the relevant protion of the surface of the deflector such that the impact energy is low enough to resist breakage of crystals. The crystals and/or the deflector may be wetted to lubricate the deflector.

Thus the radial velocity of the sugar crystals passing into the sugar chamber is interrupted by the deflector causing the crystals to decelerate and to after their direction.

The deflector includes a relatively upper convex portion, a relatively lower concave portion and an intermediate portion between the upper and lower portions. The initial impact of the crystals on the deflector occurs on the intermediate portion. The radical distance from the lip of the basket to the proximate end of the intermediate portion of the deflector may be 100–250 mm, preferably 150–200 mm, e.g. about 170–180 mm. The deflector may also have a reducing radius towards its lower end.

The intermediate portion of the deflector has an angle of less than 45° horizontal, preferably less than 15° to horizontal. Conversely expressed the intermediate portion has an angle of greater than 55°, preferably greater than 75° to the axis of rotation of the basket, which typically is vertically extending.

This feature of the deflector causes the crystals to strike the deflector with a glancing blow rather than a direct impact, and then to make subsequent impacts with the deflector as they are slowed down. Preferably the crystals impact with the deflector 3 to 20 times, more preferably at least 6 times, and most preferably at least 10 times.

The contact between the crystals and the deflector is believed to cause a film of sugar and/or syrup to form which can then initiate the build up of a significant layer of sugar and/or syrup. This may be reduced by lubricating the deflector surface by applying a fine spray of water or steam near to the location where the crystals leave the basket—either onto the crystals or the basket; or by directing the water spray or steam directly onto the deflector surface.

The amount of lubricant that needs to be added for a given quality of sugar is mainly dependent on the perimeter of the first impact of the deflector. Therefore in the preferred embodiment of the invention, the mutual impact radius is kept as small as possible, the limitation being to provide sufficient gap to allow any foreign object that is likely to be contained in the massecuite to pass through the gap.

In one preferred design, the basket has two sections The first part or lower section has a cone half angle from the axis less than 26° and preferably in the range 0° to 15° and more preferably in the range of from 9° to 12° . The screen length of this section in combination with the screen type (mainly filtration resistance as determined by parameters such as aperture size, open area and thickness) are selected to achieve orgy sufficient removal of the syrup such that the transition from filtration mechanism to drainage mechanism does not occur in the lower section. For very low viscosity syrups, it may be preferable for the screen in the lower section to be such that effectively no syrup is removed.

The upper section has a cone half-angle from the axis which is preferably larger than in the lower section, and which may be greater than 18° , depending upon the size and other characteristics of the solids being centrifuged. For sugar crystals having an equivalent diameter greater than 600 $\mu$m, the preferred cone half angle is in the range 24° to 26° , and preferably 25° . This part of the basket has the screen such that syrup is removed rapidly and that the greater part of the screen is above the drainage transition and thus dedicated to removing residual syrup by the mechanism of drainage and usually aided by washing.

The deflector shape and location are determined by the requirements to have the impacting crystals approach the impact point on the deflector surface at a small angle and then for there to occur a number of subsequent impacts (at least 6to 10) at short intervals and then after leaving the deflector to have a long flight path before impact with the casing of the centrifugal separations apparatus, Thus, there are three design criteria to which the shape and location of the deflector are directed—firstly, to minimize the initial crystal impact angle; secondly, to have many crystal impacts with the deflector surface; and thirdly, to have as long a crystal flight path as possible after leaving the deflector.

Figure 11:
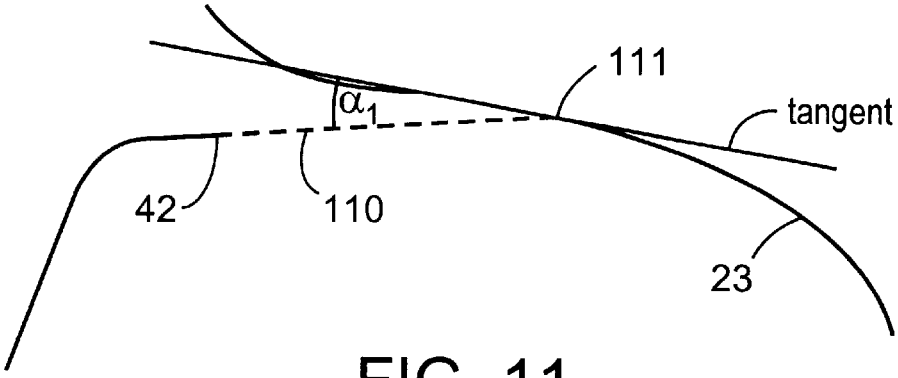
FIGS. 11 and 12 respectively show the initial impact angle of crystals with the deflector.
Figure 12:
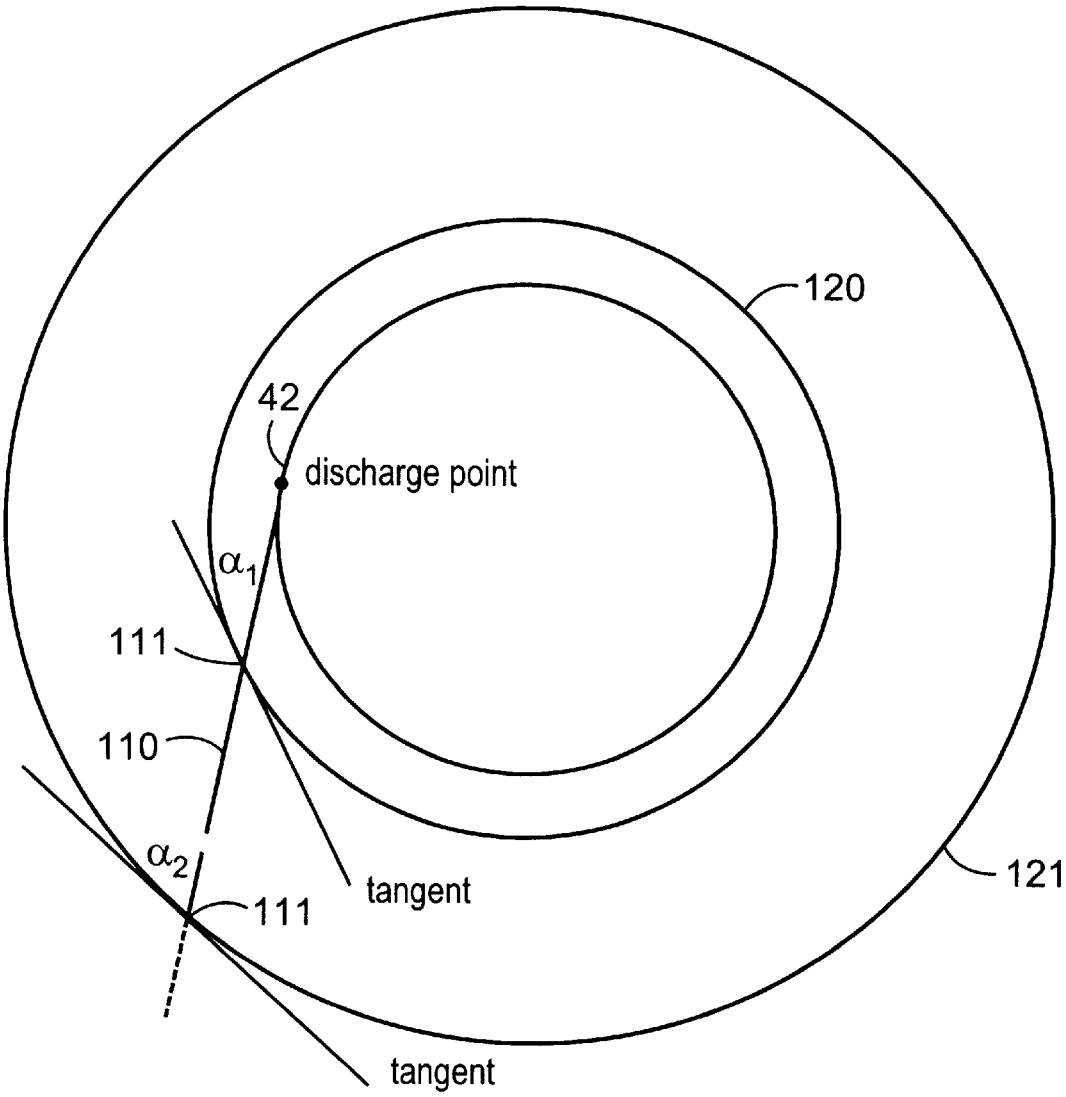

To satisfy the first criterion the deflector shape and location are such that a tangent drawn in a sectional elevation of the deflector through the impact point will be small as shown in FIG. 11. Further the impact approach angle in plan view is reduced as shown in FIG. 12. This must be balanced by the need to leave adequate radial clearance between the basket lip and the deflector to allow for movement and the passing of foreign objects and lumps.

To meet the second criterion, namely to design a deflector which ensures several impacts at short intervals, use is made of a three dimensional computer model which was developed to accurately predict the trajectory of sugar crystals upon leaving a centrifuge and impacting deflectors of various shapes. This computer model also predicts the path of crystals after leaving the deflector so that the third rationale of, achieving a long flight path before further impacts with the casing can be achieved.

The abovementioned computer model was developed to accurately predict the trajectory of sugar crystals upon leaving a centrifuge and impact with deflectors of various shapes. Such computer programs are capable of handling a variety of shapes of deflector including multiple cones, continuous curves, combinations of cylinders and such like to determine the crystal path.

The programs follow the trajectory of individual crystals as they leave the centrifuge basket and impact many times with the deflector, the casing and the discharge cone. Many variables are included to make the model universally applicable, such as the vertical velocity up the basket, the distance to the deflector, the shape of the deflector, geometry of the casing and discharge cone, and the impact efficiency.

The programs have been used to design a self cleaning deflector of the present invention in which the crystal impacts many times with the deflector—commonly more than 12. Without being bound by theory, applicant believes that the crystals should remain close to the surface between impacts to reduce the build up of deposits.

Figure 8:
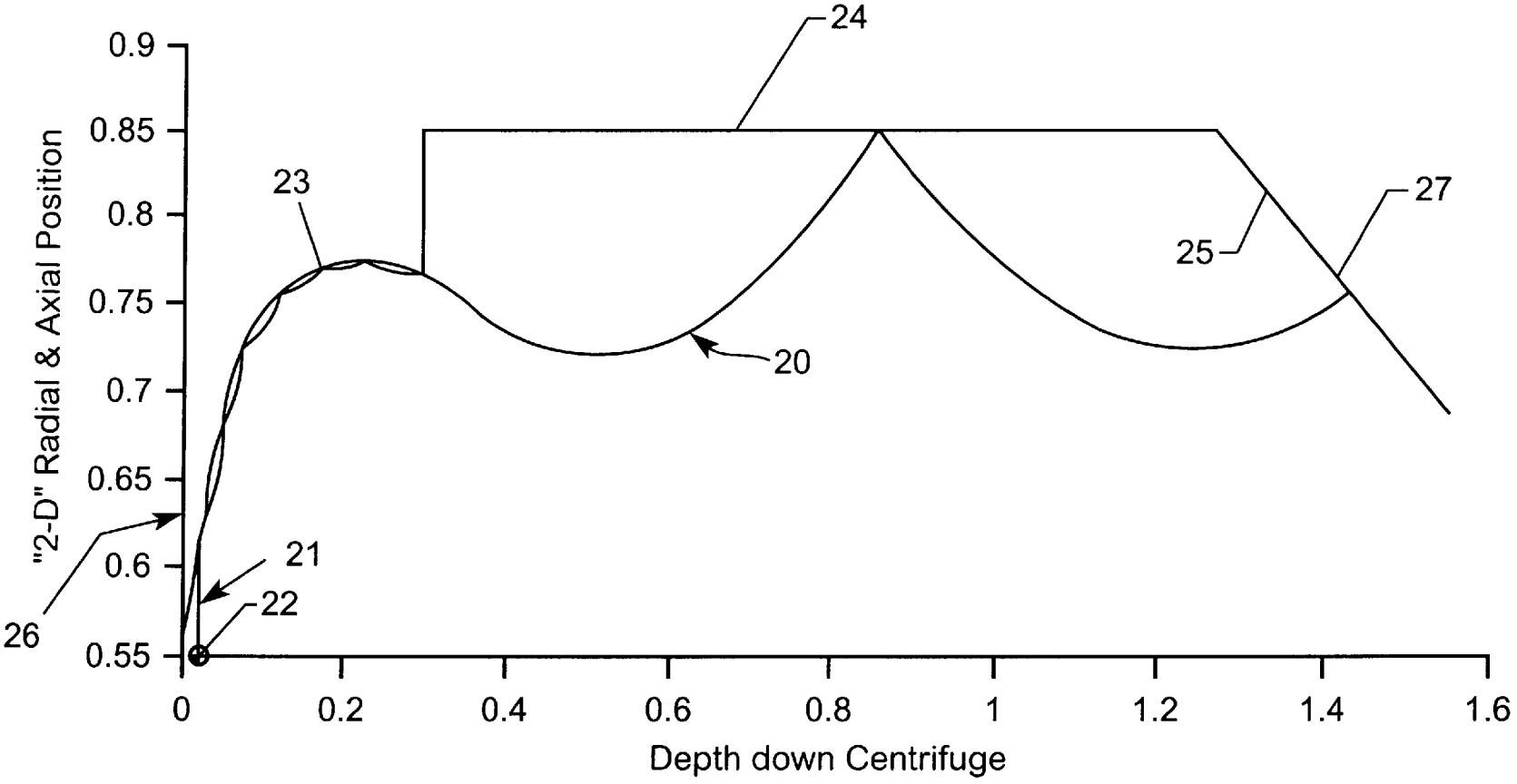
FIG. 8 is a diagrammatic representation of a crystal bounce profile for a deflector of the present invention.

Trajectory models can handle a variety of shapes of deflectors including multiple cones, continuous curves, combinations of cylinders or such like to determine the crystal path. One preferred embodiment is given when the curve representing the deflector shape is given by an equation of the form $$R_{ref}-R=(K1/Z)^{K2}+K3Z^{k4}$$

where the variables R and Z are defined in FIG. 8 and the parameters $R_{ref}$, K1, K2, K3 and K4 have the following values:

$R_{ref}$=0.7 to 1.2 and preferably about 0.85

K1=0.0005 to 0.002 and preferably about 0.001

K2=0.4 to 0.66 and preferably about 0.5

K3=0 to 3 and preferably about 2.5

K4=0 to 4 and preferably about 3.5

Figure 6:
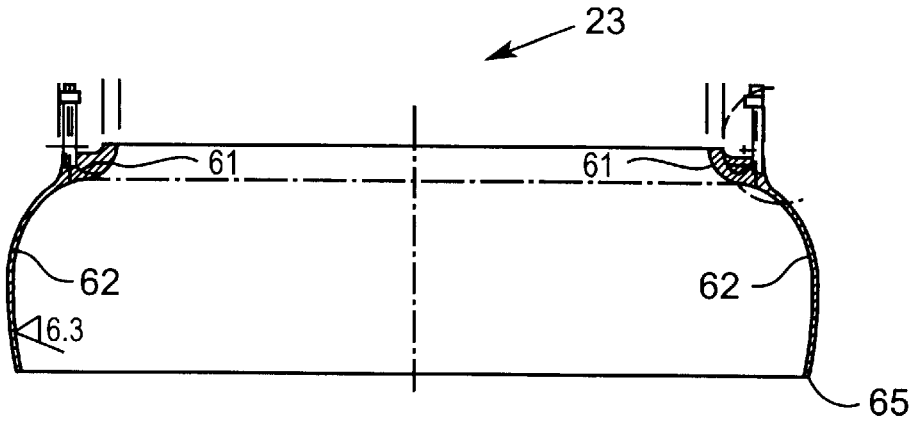
FIG. 6 is a sectional view of a deflector for the centrifugal separations apparatus of FIG. 1.
Figure 7:
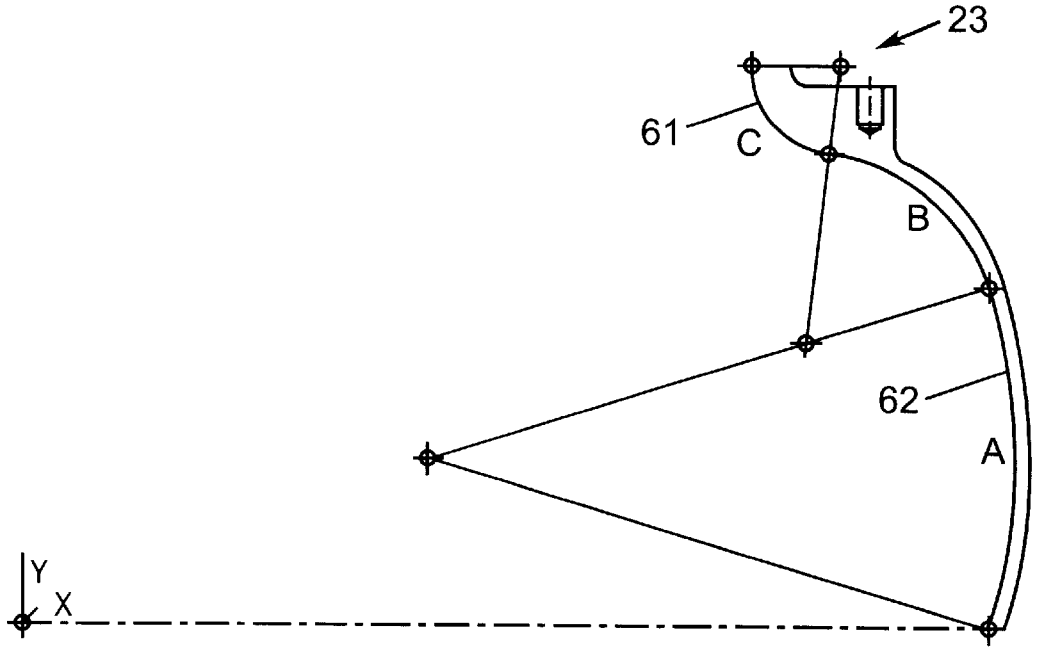
FIG. 7 is a diagrammatic section view of a portion of the deflector of FIG. 6.

It will be appreciated that other shapes may satisfy the three criteria set forth above, The parameters above provide a deflector shape close to the one shown in FIGS. 6 and 7 which has been found to achieve the desired physical and process objectives in practice.

The crystal bounce profile in FIG. 8 is based, upon the deflector defined by the above listed parameters when substituted into the above deflector curve, and having on assumed bounce efficiency of one (1). In practice, the bounce efficiency is less than one (1) and this would after the bounce profile slightly. Observation of operating deflectors in accordance with the invention, and in particular, in accordance with the above listed parameters, suggest that the crystals in fact remain very close to the deflector surface and even appear to slide across the deflector.

It is believed that the lip radius incorporated in the top of the basket provides a narrow impact zone on the deflector for substantially all crystals and the shape of the deflector described above tends to cause sliding motion across the deflector rather then head on collision.

In one embodiment, a direct drive arrangement may be used to spin the basket as this obviates the need for vee belts and the associated guarding which provides a site for crystals to impact and for lumps to form. Using the direct drive arrangement, the rotating gear and the syrup chamber may be supported on the frame by a structural "spider" with webs which may be substantially parallel to the angular motion of the crystals which have left the deflector in order to reduce the area for crystal impacts and lump formation.

After failing off the deflector, the crystals pass into the lower part of the solids collection chamber or sugar chamber which typically includes a conical discharge hopper. The bottom of the sugar chamber includes a blending apparatus which massages and blends the sugar crystals to evenly distribute moisture and break up any agglomerates of wet sugar which may have formed.

Thus the sugar crystals are subjected to relatively gentle conditions of shear to produce a crystal product that is consistent in terms of crystal size, moisture and residual syrup or impurity levels, in one embodiment this is achieved by shearing the sugar between two surfaces where the maximum differential linear speed is less than 30 $ms^{-1}$ and greater than 0.3 $ms^{-1}$ but preferably in the range 3 to 10 $ms^{-1}$.

Furthermore, one of the surfaces may be perforated such that the blended sugar crystals discharge from the machine through the perforations. The perforated surface may be stationery and the moving surface may be a rotor having arms which extend out to the diameter of the stationery surface, continually sweeping the surface.

The gap between the surfaces may be between 1 mm and 50 mm but preferably is between 3 mm and 12 mm. Similarly, in the configuration where one of surfaces is perforated, the size of the openings may be between 1 mm and 50 mm but preferably is between 3 mm and 12 mm or more preferably between 5 mm and 8 mm.

For convenience in terms of equipment maintenance, the shearing device may be located at the point of discharge of the product sugar leaving the sugar chamber. This will usually be at the bottom of the conical discharge hopper but may be at an alternative location, eg downwardly adjacent the first impact of the crystals with the sugar chamber wall. Typically the shearing device will be at a location where the crystals have a downward velocity component.

Referring to FIG. 1, a centrifuge apparatus 10 includes a centrifuge basket 11 operatively associated with a feed inlet 32, a syrup discharge port 31 operatively associated with the filtrate side of the centrifuge basket 11 and a crystal discharge 18 operatively associated with a sugar chamber 24. A sugar chamber is separated from the filtrate side of the centrifuge basket 11 which forms a syrup chamber 30 by a syrup chamber wall 19.

The apparatus also includes a deflector 23 within a monitor casing 28 which connects to the wall of the sugar chamber 24 as shown. A discharge cone 25 is connected to the base of the sugar chamber 24.

The syrup chamber 30 opens into a syrup discharge port 31.

Additionally, three water spray lines 33 am provided together with a steam lance 34 into the centrifuge apparatus 10. The spray lines 33 are supplied with water and the flow of water out of the lines is controlled by control valves. Steam can be caused to issue out of the steam lance 34.

The centrifuge basket 11 is rotated by a centrifuge motor 37 and the centrifuge apparatus 10 is supported on four centrifuge mounts 38 (two of which are shown).

Figure 2:
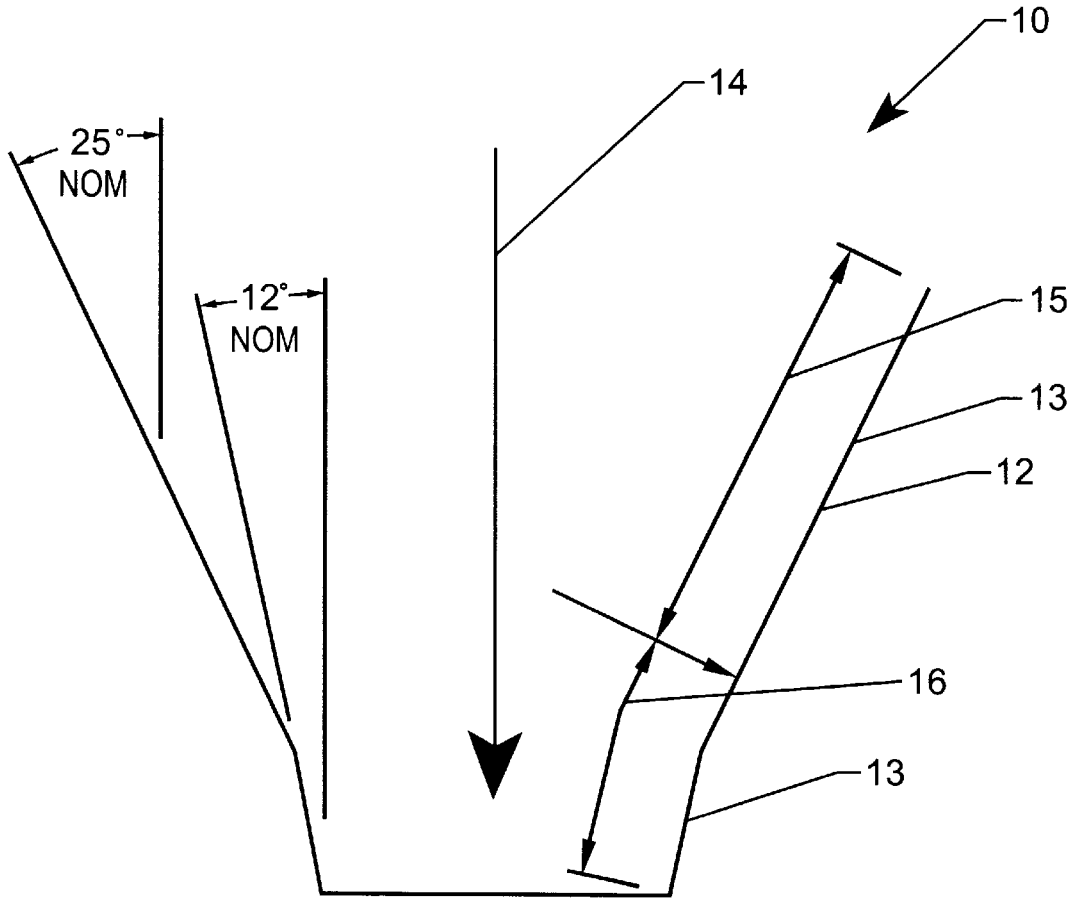
FIG. 2 is a diagrammatic representation of a centrifuge basket for the centrifugal separations apparatus of FIG. 1.

Referring to FIG. 2, the centrifuge basket 11 includes a top section 12 and a bottom section 13. The bottom section 13 has a nominal pitch of 12° from the vertical and the top section 12 has a nominal pitch of 25° from the vertical.

Figure 3:
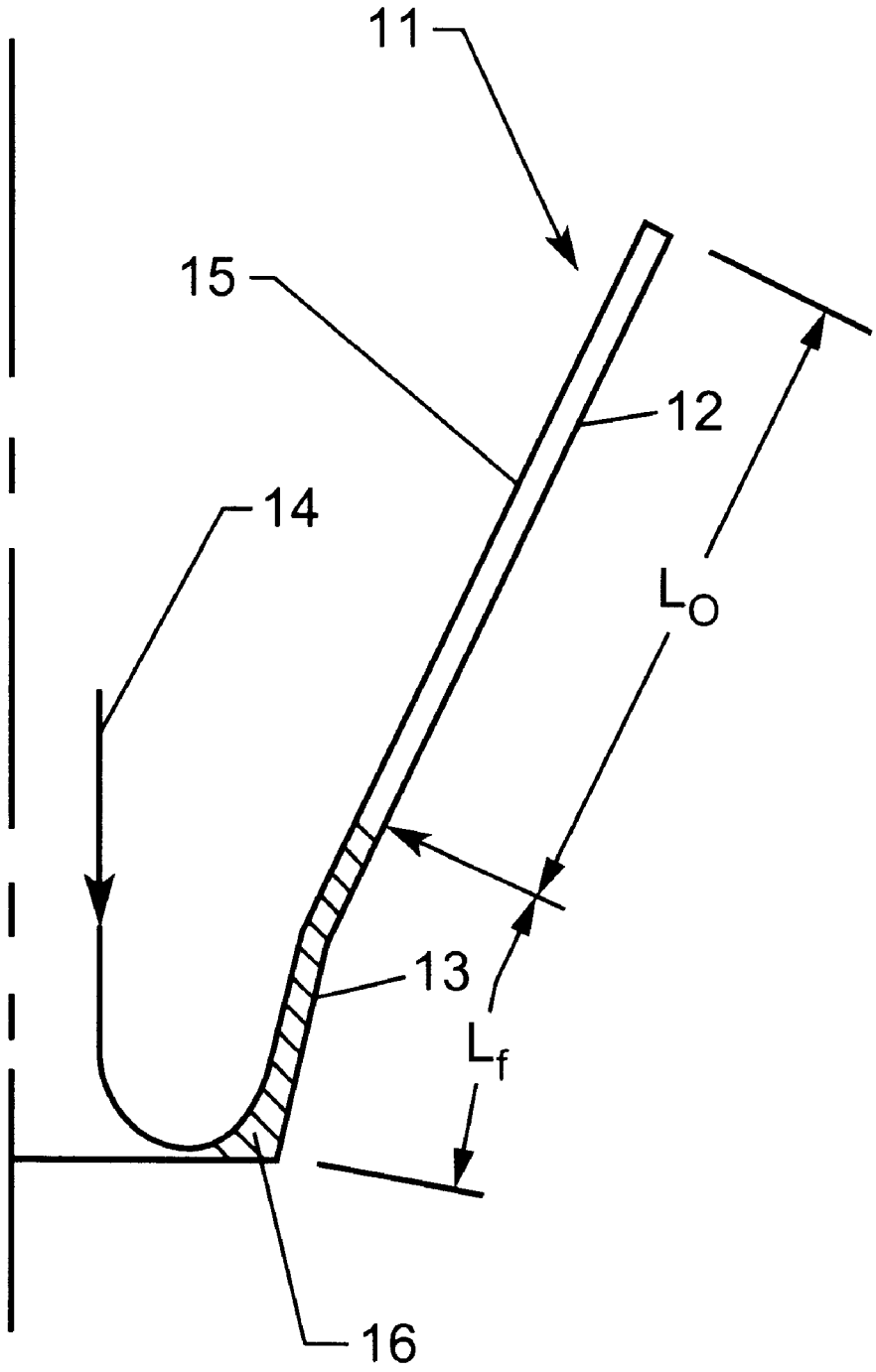
FIG. 3 is a diagrammatic representation of a portion of a centrifuge basket showing the disposition of feed stock thereon.

Referring to FIGS. 2 and 3, a filtration zone 16 extends through the bottom section 13 and partly into the top section 12 and a drainage, zone 15 extends the remainder of the way through the top section 12. The transition between the filtration and drainage zone 15 should be above the transition between the top section 12 and the bottom section 13. That is, the drainage zone 15 needs to be where the basket angle is preferably greater than or equal to 24°. When the viscosity is low, it may be that the filtration zone 15 is entirely in the top section. In other words, the bottom section 13 would have a screen of very high filtration resistance or not be perforated. The length of the drainage zone 15 is preferably from 6 to 20 times the length of the filtration zone 16. The length of the drainage zone 15 in proportion to the filtration zone increases with the efficiency of removal of impurities from the solids being filtered, and also as the viscosity of the syrup increases and as the particle size decreases.

The wall of the centrifuge basket 11 includes a supporting mesh having a relatively high transverse permeability supporting a litter semen of an aperture size selected to retain crystals above a desired size.

Figure 4:
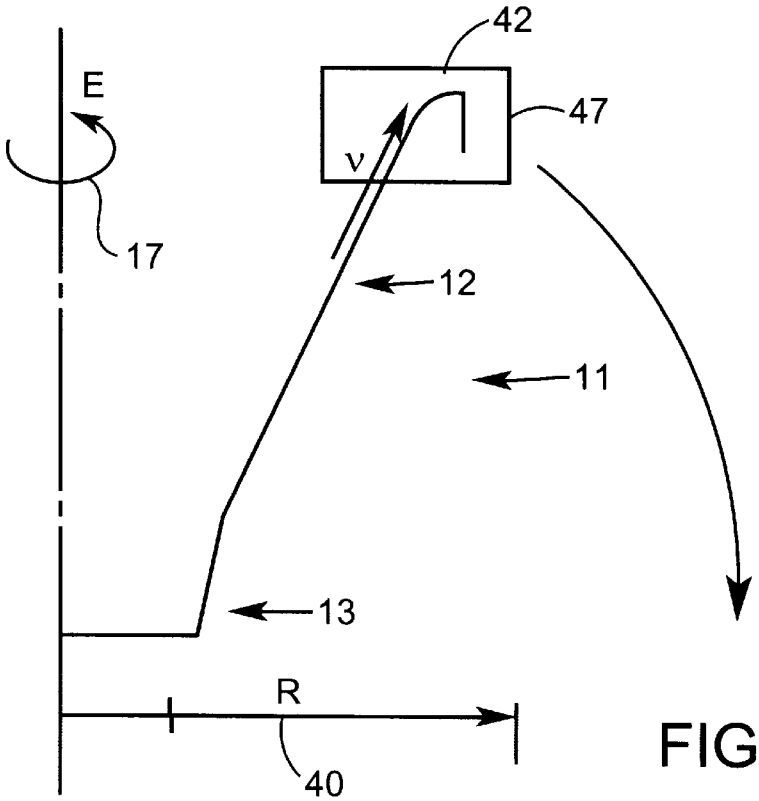
FIG. 4 is a diagrammatic representation of a portion of a centrifuge basket showing the shape of the basket lip.
Figure 5:
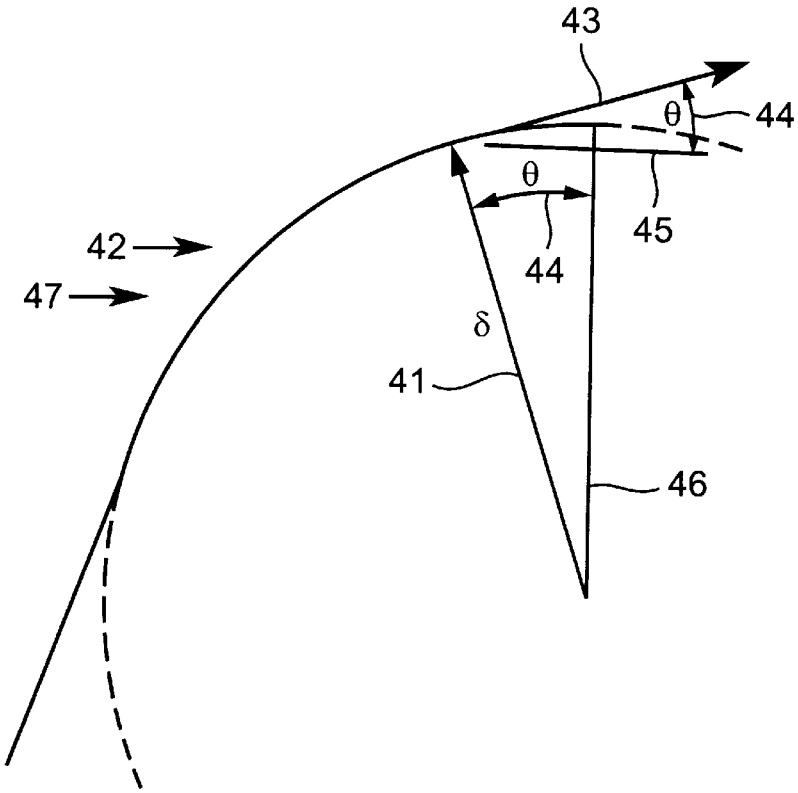
FIG. 5 is a diagrammatic detail portion of the basket lip of FIG. 4 and showing the trajectory of crystals discharged therefrom.

Referring to FIGS. 4 and 5, the centrifuge basket 11, a portion of which is shown diagrammatically is rotatable in the direction of a rotation arrow 17 and includes a discharge lip 42.

The centrifuge basket 11 has a centrifuge radius 40 represented by the symbol R, and the lip portion detail 47 shows that the lip 42 has a lip radius 41 represented by the symbol δ. Sugar crystals leave the lip 42 at the centrifuge radius 40 to follow a crystal trajectory 43. The crystal trajectory 43 is at a trajectory angle 44, represented by the symbol θ, with respect to a horizontal 45. By mensuration, the trajectory angle 44 is complementary identical with respect to a vertical 46.

The lower end is radially inwardly spaced from the wall of the sugar chamber 24. This feature causes the crystals to have a long flight path prior to impact.

Referring to FIGS. 6 and 7, the deflector 23 includes an inwardly curving portion 61, an outwardly curving lower concave portion 62 and an intermediate portion between the concave and convex portions. This is described in more detail later with reference to FIG.11.

Referring to FIG. 7 in particular, the deflector 23 is in a preferred embodiment formed having arcs A, B and C having the radii set forth below.

| ARC | | A | B | C |
|---|---|---|---|---|
| START | X | 760.000 | 759.252 | 633.846 |
| | Y | 0.000 | 270.672 | 375.081 |
| CENTRE | X | 326.226 | 616.014 | 642.168 |
| | Y | 132.373 | 226.145 | 444.585 |
| END | X | 759.252 | 633.846 | 572.168 |
| | Y | 270.672 | 375.081 | 444.585 |
| ARC RADIUS | | 460.00 | 150.00 | 70.00 |
| ANGLE | | 34.22 | 65.9 | 83.17 |

Referring to FIG. 8, a crystal bounce profile 20 shows a "two dimensionalized" representation of a trajectory 21 of a crystal discharged from the lip of the centrifuge basket 11 of FIGS. 1 and 2. The crystal strikes a deflector 23 before entering a sugar chamber 24 and discharge cone 25, It will be appreciated that the crystal bounce profile 20 is in the form of a spiral, and is shown in two dimensions by disregarding the circumferential or tangential position of a discharged crystal. Additionally, the profile depicted in FIG. 8 is diagrammatic and shows five impacts for clarity, whereas the number of impacts for this shape of deflector predicted by the model is in fact more than twelve with a concentration of bounces near the initial impact point.

Figure 9:
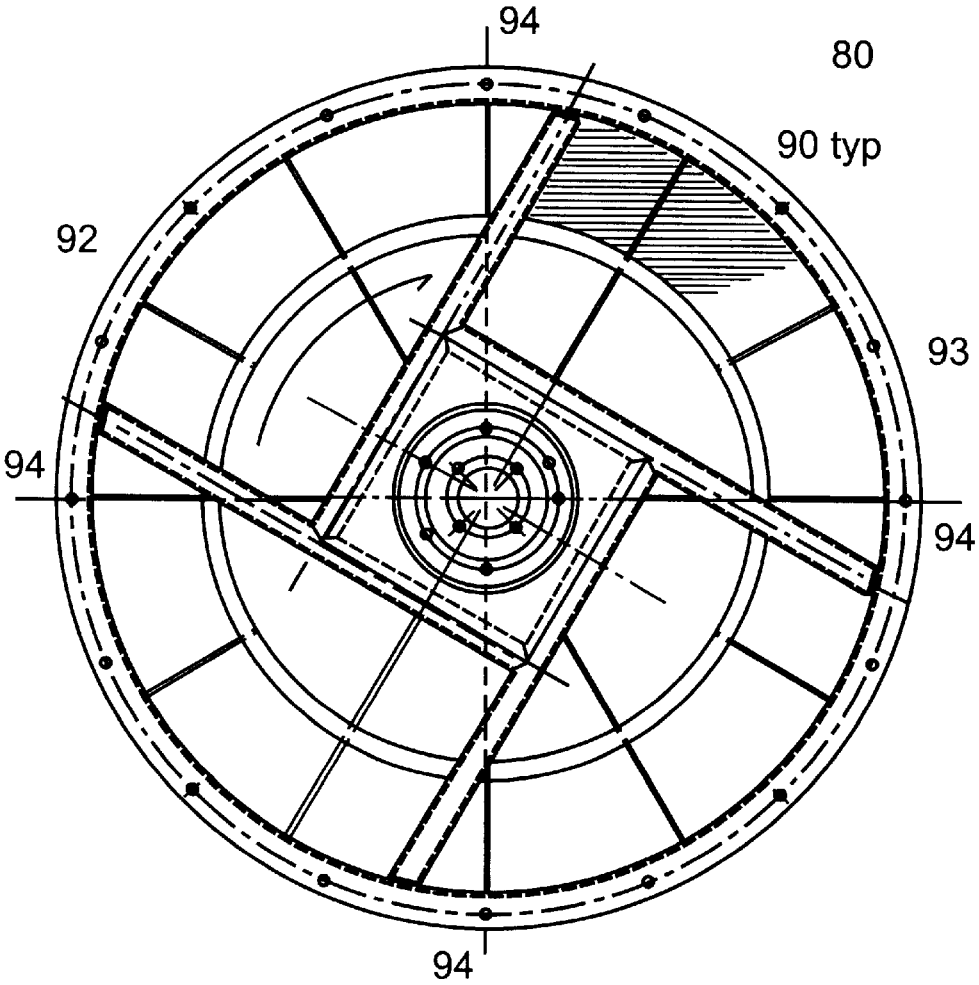
FIGS. 9 and 10 respectively show a blender assembly in plan and elevation.
Figure 10:
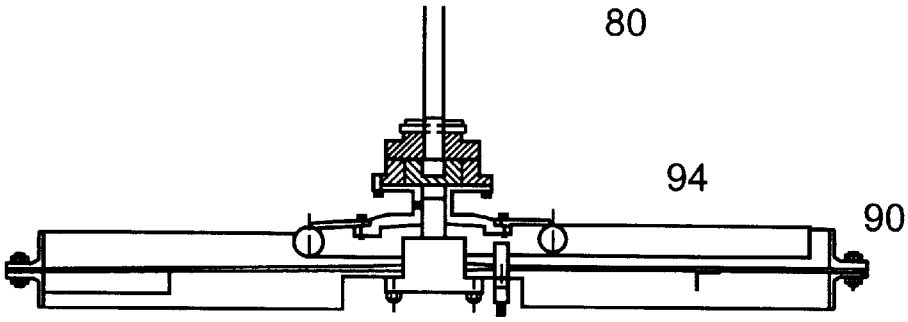

Referring to FIGS. 9 and 10, the sugar crystals after leaving the deflector impact with the casing and fall through the conical discharge hopper and into a blending apparatus 80. The solids fall onto a screen 90. Some of the solids pass through the screen 90 while the remainder rest on the screen 90 and are massaged between one of four rotor arms 94 of a rotor 93 and the screen 90. Some of the sugar may also travel with the rotor arms 94 as they rotate in the direction of arrow 92. The screen 90 is comprised of a woven mesh having square apertures approximately 7 mm on each side so that the blended product passes easily through the apertures under the gentle pressure of the rotor.

The massaging produces a relatively free flowing granular material which is free of lumps.

In the embodiment illustrated, the rotor arms 94 are made from 20 mm to 40 mm diameter round bar. The clearance between the bottom of the rotor arms 94 and the screen 90 is about 8 mm. The outside diameter of the rotor arms is the same as the screen deck diameter and is about 1000 mm. The rotational speed of the rotor is about 150 rpm. Under them conditions, effective blending and dispersion is achieved substantially without breakage of the individual crystals.

Referring to FIG. 11, the solids leave the lip 42 at a trajectory 110 and strike the deflector 23 at an initial impact point on the intermediate portion indicated by numeral 111. Referring to FIG. 12, the trajectory 110 is shown intersecting with a close deflector 120 and a distant deflector 121, and it will be seen that the horizontal component of the initial contact angle $\alpha_1$ for the close deflector 120 is smaller than the contact angle $\alpha_2$ for the distant deflector 121. Thus, it will be seen that firstly, the position of the deflector in the vertical direction is such that the first impact 111 is close to the point of inflection on the deflector, that is, close to the junction of the inwardly curving portion 61 and the outwardly curving portion 62, whereby slight changes in the point of contact will have minimal affect on the contact angle α and that, secondly, the deflector 23 is as close as it practicable to the point of discharge from the lip 42.

In use, the centrifuge apparatus 10 may be used to separate sugar crystals from massecuite. A feed stream 14 containing a mixture of syrup and sugar crystals (massecuite) is fed through the feed inlet 32 of the centrifuge apparatus 10 and enters the centrifuge basket 11 in the bottom section 13 and part thereof is displaced to the top section 12 by the vigorous rotating centrifugal action of the basket 11.

The syrup which filters through the centrifuge basket 11 passes into the syrup chamber 30 and is discharged through the syrup discharge port 31, The sugar crystals separated from the syrup are discharged over the lip of the centrifuge basket 11 and into the sugar chamber 24 after contacting the deflector 23 a number of times. The sugar crystals from the sugar chamber 24 flow through the discharge cons 25. The rotational speed of the basket is such that the tangential velocity of the sugar crystals at the discharge is no greater than 80 $ms^{-1}$ and preferably less than 60 $ms^{-1}$. The crystals are then treated in the blending apparatus as described above.

It will of course be realised that the above has been given only by way of illustrative example of the invention and that all such modifications and variations thereto as would be apparent to persons skilled in the ark are deemed to fall within the broad scope and ambit of the invention as is claimed in the following claims.

What is claimed is:

1. A centrifugal separation apparatus for separating sugar crystals from a sugar syrup, the apparatus including:

an open topped basket having a discharge lip of curved convex configuration towards an upper end thereof over which sugar crystals pass when they are discharged from the basket; and a deflector spaced radially outwardly of the lip for deflecting sugar crystals discharged from the basket downwardly into a sugar chamber.

2. A centrifugal separation apparatus according to claim 1, wherein said discharge lip has a configuration which causes the trajectory of the sugar crystals to be independent of their size and weight and to make the initial impact at broadly the same height on the deflector.

3. A centrifugal separation apparatus according to claim 1, wherein said curved convex discharge lip has a radius greater than or equal to the radius calculated by the following formula, $$V^2/\delta=9.8 \cos \theta+Rw^2 \sin \theta$$

where

V is the relative velocity between the crystals and the centrifuge;

θ is the angle from a horizontal axis at which free solids leave the centrifuge and is less than or equal to 2;

R is the basket radius of the centrifuge at θ;

w is the rotation speed in radians per second of the centrifuge;

δ is the lip radius at the top of the centrifuge.

4. A centrifugal separation apparatus according to claim 1, wherein said deflector includes a relatively upper convex portion, a relatively lower concave portion, and an intermediate portion between the upper and lower portions.

5. A centrifugal separation apparatus according to claim 4, wherein said deflector is vertically positioned relative to said basket such that sugar crystals discharged over said discharge lip impact said intermediate portion of said deflector.

6. A centrifugal separation apparatus according to claim 5, wherein said intermediate portion of the deflector has one end proximate to the lip and another end remote from the lip, and the proximate end is spaced 100 mm to 250 min. radially outward of the lip.

7. A centrifugal separation apparatus according to claim 5, wherein the basket has an axis of rotation, and the intermediate portion of the deflector extends at an angle of greater than 75° to the axis of rotation.

8. A centrifugal separation apparatus according to claim 5, wherein the basket has an axis of rotation, and the intermediate portion of the deflector defines an angle of less than 15° with a line extending perpendicular to the axis of rotation.

9. A centrifugal separation apparatus according to claim 1, wherein the intermediate portion of the deflector has an angle of inclination such that each crystal impacts with the deflector 3 to 20 times.

10. A centrifugal separation apparatus according to claim 1, further including a blender for treating sugar crystals discharging from the basket, the blender including a screen space beneath said deflector onto which the sugar crystals deflected by the deflector fall, and an arm rotatable in the plane of the screen closely spaced above the screen, the arm working crystals resting on the screen to modify their particle size distribution and urge them through the screen.

11. A centrifugal separation apparatus according to claim 10 wherein the arm rotates at 3 to 10 meters per second at its circumference and is spaced 5 to 8 millimeters above the screen, to shear the sugar crystals on the screen so as to yield sugar crystals having narrow particle size distribution.

12. A centrifugal separation apparatus according to claim 1, wherein said basket includes an axis of rotation, an upper perforated portion having a cone half angle of 24–26° to the axis and a lower perforated portion having a cone half angle of 0–15° to the axis.

13. A centrifugal separation apparatus according to claim 1, further including sprays for spraying water and/or steam onto sugar crystals discharged from said basket so as to lubricate the sugar crystals.

14. A centrifugal separation apparatus according to claim 1, further including a housing within which the basket and deflector arc received, the housing defining an inlet opening in a top of to basket, a liquid outlet in a bottom of the basket, and a solids outlet extending circumferentially around the liquid outlet in the bottom of the basket.

15. A process for continuously centrifuging a sugar syrup to remove sugar crystals therefrom, the process including:

continuously feeding the massecuites into a centrifugal separation apparatus including an open topped basket having a discharge lip of curved convex configuration towards an upper end thereof over which sugar crystals pass when they are discharged from the basket, and a deflector spaced radially outwardly of the lip for deflecting sugar crystals discharged from the basket downwardly into a sugar chamber;

centrifuging the massecuites in the basket so that liquid passes through the wall of the basket and the crystals move progressively up the wall of the basket while being rotated in the basket;

discharging crystals from the basket by passing them over said discharge lip; and deflecting the crystals off the deflector downwardly towards the solids outlet.

16. A Process for continuously centrifuging sugar crystals according to claim 15, wherein sold deflecting step comprises impacting said sugar crystals 3 to 20 times with said deflector.

17. A process for continuously centrifuging sugar crystals according to claim 15, including the further step of lubricating said sugar crystals by applying a spray of water or steam onto crystals discharged over said lip.

* * * * *